US006435741B1

(12) United States Patent
Earle et al.

(10) Patent No.: US 6,435,741 B1
(45) Date of Patent: Aug. 20, 2002

(54) PROCESSING PHOTOGRAPHIC MATERIAL

(75) Inventors: Anthony Earle, Harrow Weald; Nigel R. Wildman, Watford, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/961,495

(22) Filed: Sep. 24, 2001

(30) Foreign Application Priority Data

Nov. 3, 2000 (GB) ..... 0026949

(51) Int. Cl.[7] ..... G03D 3/08
(52) U.S. Cl. ..... 396/617; 396/620; 396/626
(58) Field of Search ..... 396/620, 617, 396/626, 632; 355/27–29

(56) References Cited

U.S. PATENT DOCUMENTS 5,420,658 A 5/1995 Manico et al. ..... 396/626
5,689,751 A * 11/1997 Ueda ..... 396/626
5,899,594 A * 5/1999 Piccinino, Jr. ..... 396/612
5,980,130 A 11/1999 Earle et al. ..... 396/626
6,082,908 A 7/2000 Tumidei ..... 396/617

* cited by examiner

*Primary Examiner*—D. Rutledge
(74) *Attorney, Agent, or Firm*—Frank Pincelli

(57) ABSTRACT

A low volume processing apparatus having a narrow processing channel has the processing solution entering via passages located towards the inlet and outlet of the channel. The solution leaves the channel via a passage located in the middle thereof, the flow of solution pulling the film into a fixed position within the channel. The reversal of flow minimizes the amount of air entrained with the returning flow.

8 Claims, 1 Drawing Sheet

PROCESSING PHOTOGRAPHIC MATERIAL

FIELD OF THE INVENTION

This invention relates to a method and apparatus for processing photographic material. In particular, the invention relates to improving the flow of solution through the processor.

BACKGROUND OF THE INVENTION

The processing of photosensitive material such as photographic film involves a series of steps such as developing, bleaching, fixing, washing and drying. In this process, a continuous web of film or cut sheet of film is sequentially conveyed through a series of stations or tanks, with each one containing a different processing solution appropriate to the process step at that station.

A large photofinishing apparatus utilizes rack and tank configurations. Such an apparatus is disclosed in, for example, U.S. Pat. No. 5,980,130. This document discloses a rack for use in a low volume thin tank of a photographic processing apparatus. The rack is placed in a processing tank, defining a relatively narrow processing channel between the walls of the tank and the rack. U.S. Pat. No. 5,420,658 discloses a further low volume photographic material processing apparatus which utilizes a narrow substantially horizontal processing channel. The channel has an upturned entrance and exit to contain the processing solution within the channel.

In some conventional small low volume processors the processing solution is returned to the suction input of the circulation pump by allowing it to flow over a barrier at the ends of the processing track. This can lead to air entrainment which can oxidize the chemicals in the solution. Also the solution and aerated solution is returned to the processing chamber to process the film through jets. The position of the jets in relation to the film is not constant. This can give rise to process density variations.

The present invention aims to overcome the problems mentioned above.

SUMMARY OF THE INVENTION

According to the present invention there is provide a method of processing photographic material comprising the steps of; feeding the photographic material into a processing channel having an inlet and an outlet; circulating processing solution through the channel such that the solution enters the channel at solution inlets located towards the inlet and the outlet of the channel and exits at a solution outlet located between the inlet and the outlet of the channel, the flow of solution pulling the material down to a fixed position against the surface wall of the channel, and withdrawing the material from the channel once processing is complete.

The invention further provides an apparatus for processing photographic material, the apparatus comprising a module having an upper section and a lower section together defining a processing channel having an inlet and an outlet, a plurality of passages defined in the lower section, the processing channel being in fluid communication with a reservoir of processing solution via the passages, and pumping means for pumping the processing solution through the passages and the channel, wherein the pumping means is configured such that the processing solution enters the channel via the passages nearest to the inlet and outlet of the channel and exits the channel via the other passage, thereby pulling the material down to a fixed position against the surface wall of the channel and ensuring that substantially no air enters the passage through which the solution exits the channel.

Preferably the surface of the wall of the channel is textured. This achieves good agitation of the flow.

The apparatus and method of the invention prevents the drawing of air into the processing system and thus prevents the oxidation of the solution. By reversing the flow of solution overflow of the system is eliminated should the pump inlet be blocked.

By having the suction return from the lowest part of the processing channel the film is pulled downwards and becomes fixed with respect to the flow of solution. Uniform sensitometry is thus achieved.

The suction of the pump holds the film against the outlet to the pump at a constant predetermined distance. This raises the agitation of the solution by making use of the channeling properties of the surface pattern.

Good agitation of the solution over the film surface is achieved by wiping action over the textured surface of the processing module and the high velocity of the solution through the surface pattern. The textured surface allows free flow of solution over the sensitized surface of the material.

The invention can accommodate any process for color film, color paper, reversal film, reversal paper, black and white film or paper.

BRIEF DESCRIPTION OF THE DRAWINGS

The invention will now be described, by way of example, with reference to the accompanying drawings in which.

DETAILED DESCRIPTION OF THE INVENTION

Figure 1:
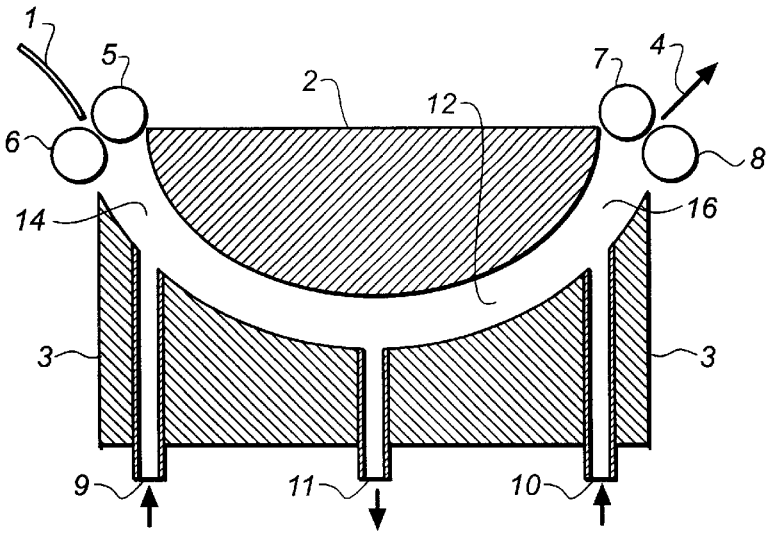
FIG. 1 shows a cross section of a low volume processing apparatus according to the invention.

Referring now to the drawings in detail, FIG. 1 shows a cross section of a process tank module.

The process tank module has an upper section 2 and a lower section 3. A narrow curved processing chamber or channel 12 is defined between the upper and lower sections. The module has an inlet 14 for the material to be processed 1 to enter the processing channel and an exit 16 for the material to exit the channel. The inlet 14 and outlet 16 define the highest points of the curve of the channel. A pair of rollers 5 and 6 are provided at the inlet 14. A further pair of rollers 7 and 8 are provided at the outlet 16. These rollers, 5, 6, 7 and 8, drive the material to be processed 1 through the processing channel, to exit in the direction of arrow 4.

The lower section of the module 3 is provided with three passages 9, 10 and 11. These passages run substantially vertically through the lower section 3 and connect the processing channel 12 to a supply of processing solution, not shown. Passages 9 and 10 are located towards the inlet 14 and outlet 16 respectively of the tank module. These passages are inlet passages for the flow of processing solution. Passage 11 is the outlet passage for the flow of processing solution and is located at the lowermost point of the lower section 3. Thus the entrance points of passages 9 and 10 to the processing chamber are higher than the entrance to passage 16.

A pump, not shown, is provided to pump processing solution up through passages 9 and 10.

The process tank module may stand alone or be easily combined with other modules to form a continuous low volume unit for processing photographic materials. Any desired number may be provided.

In operation the processing solution enters the processing channel 12 via passages 9 and 10. The solution exits the channel via the passage 11. The solution is circulated through these passages by means of a pump, not shown.

Figure 2:
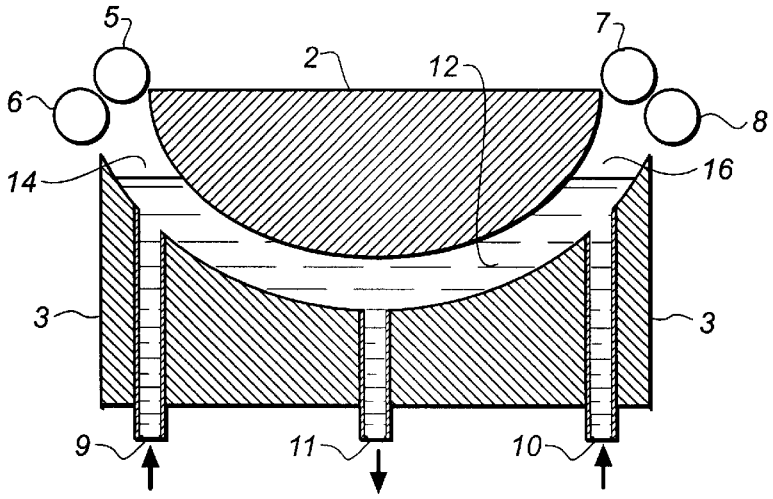
FIG. 2 illustrates the flow of solution in the apparatus shown in FIG. 1.

As can be seen in FIG. 2 the level of solution pumped in via passages 9 and 10 is well above the level of the entrance to the passage 11. By providing the outlet for the solution at the lowermost point of the lower section 3 the problem of air becoming entrained in the solution sucked back by the pump is considerably reduced. Thus the chemicals within the solution will not be subject to oxidation.

Figure 3:
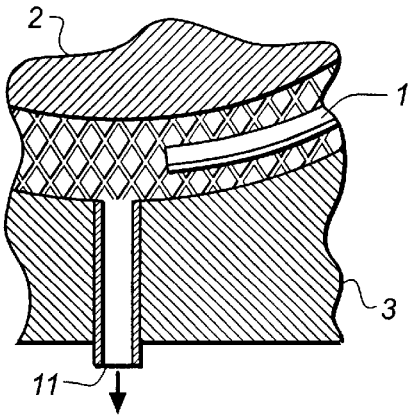
FIG. 3 is an enlarged view of part of the channel in the processing apparatus according to the invention.

The material to be processed, for example film, is fed into the processing channel 12 by rollers 5 and 6. The film may be in cut sheet or roll format. The material may contain an emulsion on either or both of its surfaces. FIG. 3 illustrates how the return flow of the solution through passage 11 draws the film 1 down to register against the bottom of the processing channel. This action fixes the film position with respect to the flow of processing solution. The action of continually applying processing solution through passages 9 and 10 and withdrawing the solution through passage 11 helps to improve agitation of the chemicals in contact with the material being processed. Once the film is processed the rollers 7 and 8 withdraw the film from the processing channel.

The surface of the channels is preferably textured. The textured surface prevents the photosensitive material from sticking to the surfaces of the channel due to surface tension. The textured surface also aids in uniform distribution of processing solution across the photosensitive material enhancing process uniformity and solution agitation. It encourages disturbance in the flow which leads to improved solution agitation and more uniform processing. Furthermore, a textured surface helps to prevent contaminants and debris from scratching, abrading or pressure sensitizing the photosensitive material.

The textured surface may be textured by any known process, e.g. knurling, molded, EDM electro-discharges machine or applied.

In the embodiment shown in FIG. 3 the surface is textured with a diamond relief pattern. However, any suitable profile may be utilized. The surface may be pyramidal, have a random surface or any other flow disturbing surface. The textured surface increases the agitation of the processing solution since the actual flow velocity is raised as the solution rushes along the open channels in the diamond relief pattern. The actual flow in the embodiment illustrated can be controlled by the dimensions of the grooves in the diamond pattern. The grooves can be modified to give the required flow. By changing the groove dimensions in each processing module the flow can be different in each module. As stated above, the film is fixed with respect to the flow of solution while it is being processed.

The invention has been described in detail with reference to a preferred embodiment thereof. It will be understood by those skilled in the art that variations and modifications can be effected within the scope of the invention.

PARTS LIST

1 material
2 upper section of module
3 lower section of module
5 roller
6 roller
7 roller
8 roller
9 passage
10 passage
11 passage
12 channel
14 inlet
16 outlet

What is claimed is:

1. A method of processing photographic material comprising the steps of; feeding the photographic material into a processing channel having an inlet and an outlet; circulating processing solution through the channel such that the solution enters the channel at solution inlets located towards the inlet and the outlet of the channel and exits at a solution outlet located between the inlet and the outlet of the channel, the flow of solution pulling the material down to a fixed position against the surface wall of the channel and withdrawing the material from the channel once processing is complete.

2. A method as claimed in claim 1 wherein the flow of solution is aided and agitated by texturing the surface of the channel.

3. Apparatus for processing photographic material, the apparatus comprising a module having an upper section and a lower section together defining a processing channel having an inlet and an outlet, a plurality of passages defined in the lower section, the processing channel being in fluid communication with a reservoir of processing solution via the passages, and pumping means for pumping the processing solutions through the passages and the channel, wherein the pumping means is configured such that the processing solution enters the channel via the passages nearest to the inlet and the outlet of the channel and exits the channel via the other passage, thereby pulling the material down to a fixed position against the surface wall of the channel and that substantially no air enters the passage through which the solution exits the channel.

4. Apparatus as claimed in claim 3 wherein the processing channel is curved, the passages through which processing solution enters the channel being located at higher points of the curve and the passage through which the processing solution exits the channel being located at a lower point in the curve.

5. Apparatus as claimed in claim 3 wherein the surface of the processing channel is textured.

6. Apparatus as claimed in claim 3 wherein the surface of the processing chamber has a diamond grooved pattern.

7. Apparatus as claimed in claim 3 wherein roller means are provided at the inlet and the outlet to the channel to transport the material into and out of the processing channel.

8. Apparatus as claimed in claim 7 wherein more than one module is provided, the roller means provided at the outlet of the processing channel of one module also forming the roller means at the inlet to the channel of the adjacent module.

* * * * *

UNITED STATES PATENT AND TRADEMARK OFFICE

CERTIFICATE OF CORRECTION

PATENT NO. : 6,435,741 B1
DATED : August 20, 2002
INVENTOR(S) : Anthony Earle et al.

It is certified that error appears in the above-identified patent and that said Letters Patent is hereby corrected as shown below:

Column 4,
Line 42, insert -- ensuring -- after the word "and"

Signed and Sealed this

Twenty-sixth Day of November, 2002

*Attest:*

*Attesting Officer*

JAMES E. ROGAN
*Director of the United States Patent and Trademark Office*